United States Patent [19]

Jacobs

[11] 4,393,762

[45] Jul. 19, 1983

[54] SUNFLOWER SEED DEHULLING MACHINE

[76] Inventor: Wilson E. Jacobs, Buenos Aires, Argentina

[21] Appl. No.: 369,814

[22] Filed: Apr. 19, 1982

Related U.S. Application Data

[60] Continuation of Ser. No. 142,018, Apr. 21, 1980, abandoned, which is a continuation-in-part of Ser. No. 30,372, Apr. 16, 1979, abandoned, which is a continuation of Ser. No. 852,929, Nov. 18, 1977, abandoned, which is a division of Ser. No. 636,994, Dec. 2, 1975, abandoned.

[51] Int. Cl.[3] ..... B02B 3/00; B02B 7/02; B02C 9/02

[52] U.S. Cl. ..... 99/609; 99/519; 99/571; 99/612; 426/482

[58] Field of Search ..... 99/518, 519, 520, 524, 99/574, 575, 600, 601, 602, 609, 612–614, 617, 618, 620–622, 571; 426/482, 483

[56] References Cited

U.S. PATENT DOCUMENTS 2,651,470 9/1953 Dodds et al. ..... 99/571
4,189,503 2/1980 Giguere ..... 99/618

*Primary Examiner*—Philip R. Coe
*Assistant Examiner*—Timothy F. Simone
*Attorney, Agent, or Firm*—Allegretti, Newitt, Witcoff & McAndrews, Ltd.

[57] ABSTRACT

A machine for dehulling flat disc-like seeds having a relatively heavy kernel inside the hull comprising a spinning rotor for throwing the seeds against an annular impact band to crack the hull. The rotor consists of a disc with radial blades on the surface thereof which define channels for orienting the seeds so that they are ejected like spinning saucers and strike the impact ring at their fault lines. The radial blades may also include a sweeping fin to clear the path of seed portions which might interfere with the impacting of the seeds.

5 Claims, 5 Drawing Figures

1
2
3
3'
4
5
6'
8
a
b
IV
IV

SUNFLOWER SEED DEHULLING MACHINE

This is a continuation of co-pending application Ser. No. 142,018, filed Apr. 21, 1980, now abandoned which was a continuation-in-part of prior application Ser. No. 30,372, filed Apr. 16, 1979, now abandoned, which was a continuation of prior application Ser. No. 852,929, filed Nov. 18, 1977, now abandoned, which was a divisional of prior application Ser. No. 636,994, filed Dec. 2, 1975, now abandoned.

This invention relates to a machine for separating kernels from the hulls of sunflower seeds.

BACKGROUND OF THE INVENTION

Hulling machines used heretofore have not achieved particularly efficient results, as the resulting kernels are usually mixed with some 15% hulls, or non-hulled (whole) seeds. The separated hulls contain some 3 to 5% small pieces of kernel, which is a loss of significant value.

Also, such a high percentage of hulls in the kernels increases milling costs and reduces milling capacity, as a greater volume must be processed to obtain the same volume of dehulled kernels.

Considering further that once the oil is extracted the remaining pulp (solid) is the base for balanced animal feeds, and as hulls contain a high percentage of fiber, which is very harmful to non-ruminants and specially to chicks, it appears clearly there is a need to better the process and to decrease the hull percentage in the kernels that go to pressing, extraction, etc.

Another factor militates against the efficiency of the process, namely the absorption of oil by the separated hulls, which is most difficult to recover and constitutes an important loss. This is especially true when using hulling machines of the fixed-and-rotating-blades type; as many kernels are cut in pieces, they expel some of their oil, which particularly wets the hulls.

An attempt has been made to improve hulling machinery in which seeds are thrown against hardened surfaces and—taking advantage of the special configuration of sunflower seeds which present two substantially symmetrical "hulls" (with respect to a central plane) and a "weld" around the perimeter—impact against the hardened surface which causes the hulls to break along the weld or fault line, the kernel falling out.

But, in the impact system not all seeds are broken or hulled on impact since this depends on the position of the seed at the moment of impact if the seed impacts with one of its lateral faces or sides, the probability is that it will not break. All non-hulled or whole seeds must be separated and reprocessed with obvious disadvantages.

The above is further complicated by the fact that, as rotors spin at high velocities to achieve sufficient centrifugal force, many seeds, kernels and their pieces, rebound into the path of new seeds ejected from the rotor, this of course impedes a correct action with the result of more unhulled seeds and a further loss of efficiency.

SUMMARY OF THE INVENTION

All of the above disadvantages are practically eliminated by the use of the present invention, which ensures hulling of most of the seeds in the process.

One of the principal advantages of my machine is that, from the moment they enter the huller, seeds are guided in such a way that maximum advantage is taken of their special geometrical configuration. The rotor blades have special shapes that position seeds in a way permitting a double hulling chance, once they are ejected from the rotor.

A second advantage is provided by a second set of radial blades, which are accessory to the process. These blades protrude from the rotor and reach out to a very small distance from the hardened impact surface. They are in fact sweeping blades and are so designed that they sweep away any kernels, seeds, hulls, etc. that would rebound into the path of the flying seeds ejected from the rotor. Thus are avoided collisions and rebounds causing deviations from the desired path of the seeds moving toward the dehulling surface, consequently the proportion of unhulled seeds in the product emerging from the machine is significantly reduced.

Also, because of the attitude of the seeds when they are ejected from the rotor towards the impact hardened surface, namely, pointing toward the impact surface with the seed minor axis normally to the rotor surface, those seeds which are not hulled in the first impact, and because of the rotating energy they possess, will fall on their side violently impacting against the hardened surface on their "weld" or fault line. This adds a second hulling chance, as the kernel again can act as a wedge and separate the hull halves.

Further, the annular impact surface of the machine includes a complementary impact ring, also of annular shape, formed by a plurality of fixed blades, set beneath the impact ring, and having inclinations in two planes, which contributes to hull those few seeds that would have passed intact through the machine. This is achieved as said seeds still possess a spinning energy, enhanced by the air blown in a circular motion by the rotor. The seeds obviously impact against these plates standing directly in their path.

BRIEF DESCRIPTION OF DRAWINGS

FIG. 3 is an enlarged view of a portion of FIG. 1 showing flow of seeds through the machine and the impact of seeds against the impact ring and the fixed plates set below the impact ring.

In the several drawings identical numbers identify identical or corresponding parts; principal groups of parts are identified by letters.

DETAILED DESCRIPTION

Figure 1:
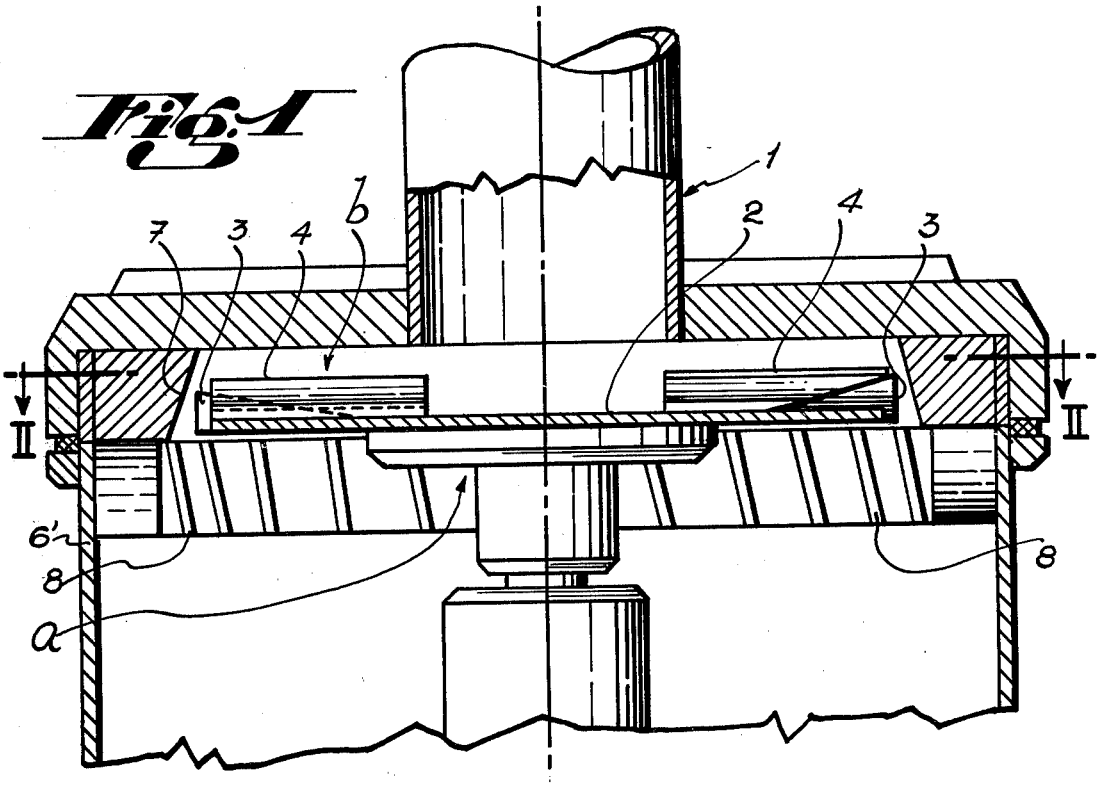
FIG. 1 is a sectional elevational view of my machine in the area surrounding the rotor. The rotor is the basic part of the seed huller. Also in the drawing can be seen the impact hardened surface, encircling the rotor and the impact plates beneath said surface.
Figure 2:
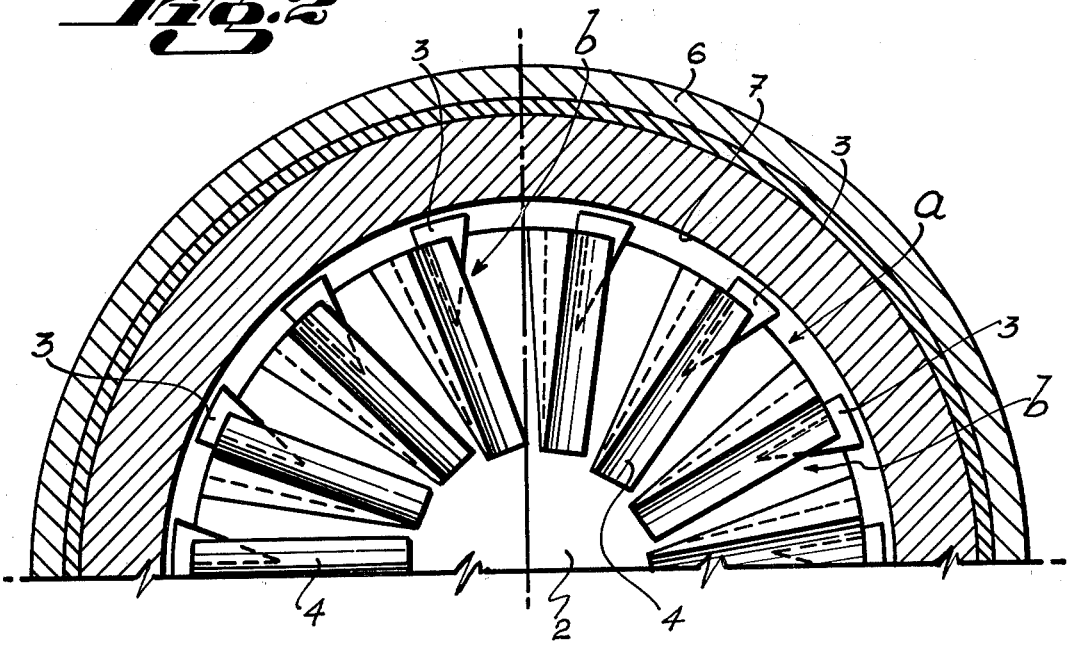
FIG. 2 is a partial plan view taken along the line II—II of FIG. 1 showing positions of the substantially radial rotor blades, and the accessory sweeping blades, which protrude from the rotor perimeter. In the drawing, the distance between tips of sweeping blades and the impact surface has been exaggerated, as in practice this distance is the minimum possible, compatible with the rotor spinning without contact.

The seed huller machine, specially adapted to handle sunflower seed, comprises a rotor a set under a feed chute 1 unloading seed in the central portion of plate or disc 2, as shown in FIG. 1.

Mounted on said disc 2 and distributed regularly in a substantially radial attitude, are blades b, placed between the central free portion of disc 2 under feed chute 1—and the perimeter of said disc. These blades have complementary sweeping fins 3 which extend out of the disc and approach the impact ring as near as possible without contact between rotor and ring.

Figures 4, 5:
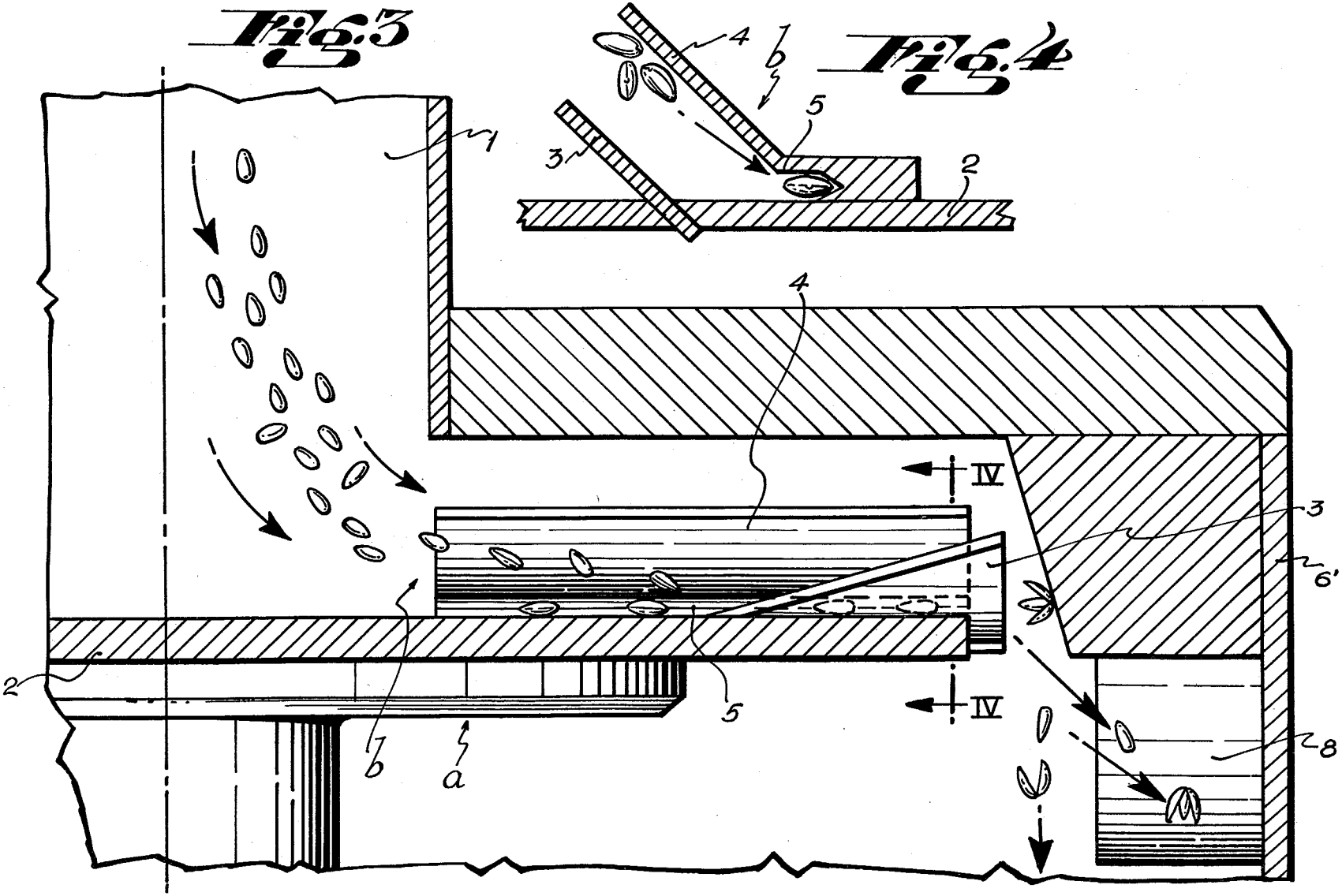
FIG. 4 is a partial detail showing a cross section of the rotor blades, taken along the line IV—IV of FIG. 3.
FIG. 5 is a partial plan view of the rotor, showing the triple hulling action on the seeds, which includes: a first end collision against the impact ring; a second lateral collision against the weld or fault line of the hull (in both these collisions the kernel inside the seed acts as a wedge and tends to separate the two halves of the hull); and a third collision against the set of tilting plates under the impact ring. In the drawing, the hardened impact ring is partially sectioned so as to expose the impact plates below.
Figure 5:
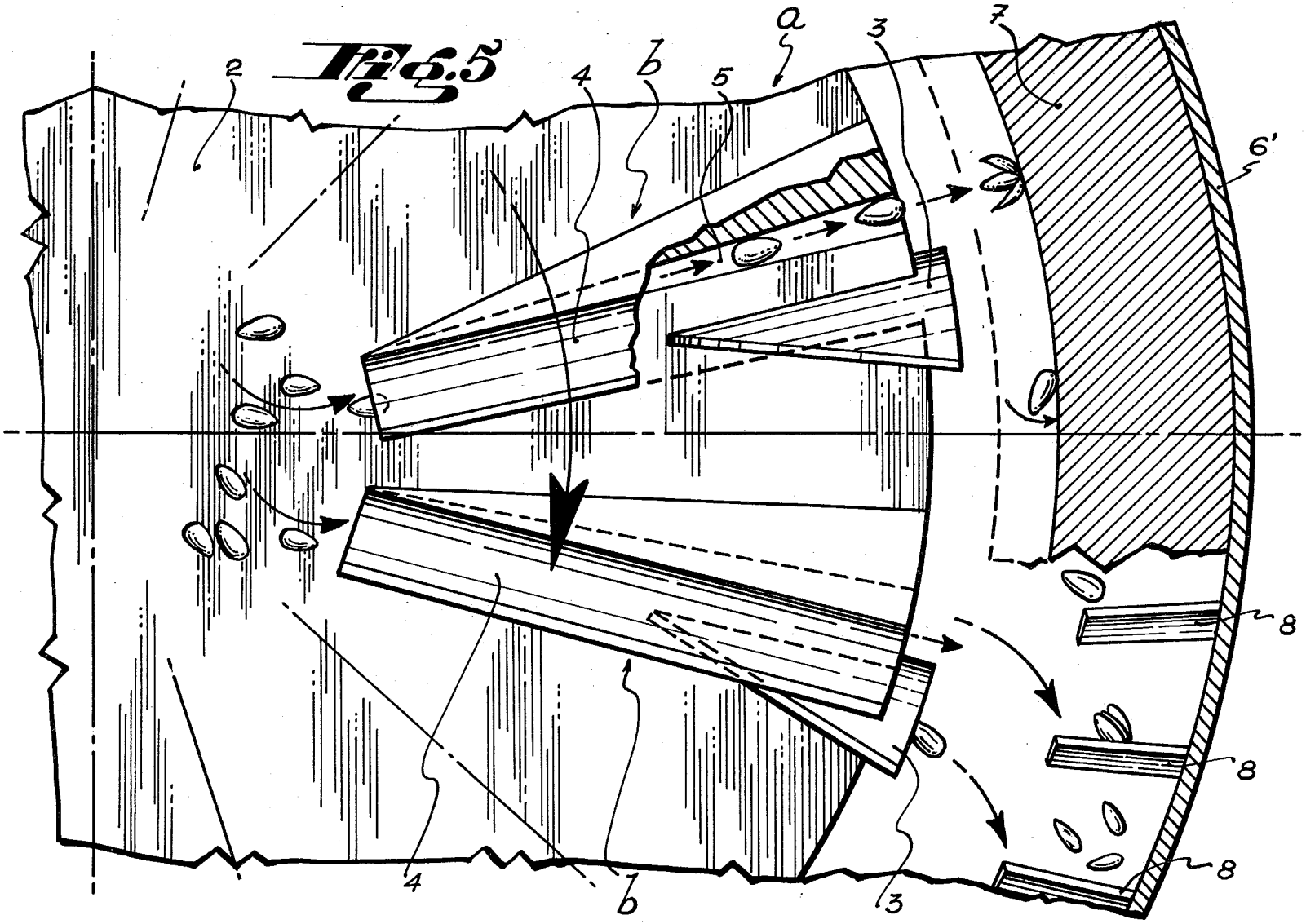

Rotor blades b include a lateral inclined plate 4, which shape "invites" and causes seeds (FIGS. 3 and 4) to enter channel 5—extending the full length of blades b and closed on one side by converging with the face of the rotor, as shown in detail in FIG. 4.

The machine is surrounded by a housing 6 on which is mounted internally an annular impact ring 7 surrounding rotor a. The internal wall of impact ring is inclined downwardly and outwardly. Fins 3 protrude beyond the circumference of the rotor to a point as close as possible to impact ring.

Under impact ring 7 there are annularly and regularly distributed around the inside of the housing fixed inclined rectangular fingers 8; said fingers present two inclinations: one with reference to the rotor radius and also with reference to the rotor axis as shown in FIGS. 1 and 5.

Longitudinal channel 5, formed by rotor blades b has an internal height corresponding to seed thickness, the smallest dimension of the seed. In the particular case of sunflower seeds, this internal height is of the order of 5 mm and is meant to position seeds so that they contact the wedge shaped bottom of the channel 5 "lying down"—in a horizontal position.

Operation of the huller is as follows, as can be seen with reference to FIGS. 3, 4 and 5. Due to spinning of rotor a, at high speed and in the direction indicated by an arrow in FIG. 5, seeds fed to the machine through tube 1 are induced—by plate 4 of rotor blades b, to enter channels 5 "lying down", that is with their major axis substantially parallel to the sides of the channels. As the internal height of each channel 5 is smaller than the width of seeds, this is the only position the seeds can adopt.

Seeds so positioned are thrown by rotor blades b—as they turn at high speed—against impact ring 7, where they impact endwise due to their orientation in channels 5. In said impact the kernels inside the seeds, relatively heavy (about 70% weight of the seed), act in wedge fashion and tend to separate the hulls along their "welds" or fault lines. This is the first hulling effect of the machine.

As seeds "fly" from the rotor with their major axis in a radial position, those which are not hulled in the first endwise impact will, because of their spinning inertia, "lie down" in the direction of turning, impacting again on the hardened ring with contact on a lateral "weld" or fault line. Again the internal kernel will act as a wedge advancing laterally, to achieve a new hulling effect.

due to high spinning speed of the rotor and the short distance between rotor and impact ring 7, those seeds, kernels or their fractions which rebound, may get in the way of seeds that are ejected normally by rotor. To avoid this effect sweeping fins 3 are placed in front of plates 4. As they turn, the fins sweep the way clean for the seeds which fly from channels 5, on their way to hulling against impact ring 7.

As seeds have a high turning energy because of inertia and the rotating air current generated by the rotor, as they fall they impact against the inclined fingers 8 set under impact ring 7, (FIG. 5). This further impact provides a third possibility for hulling any seeds which might have remained whole through the process.

The mentioned air current helps to instantaneously separate decorticated hulls from kernels, and so reduces the possibility of absorption of valuable oil by the hulls.

It is to be understood that the embodiments of the invention which have been described are merely illustrative of the principles of the invention. Modifications may be made to the disclosed embodiments without departing from the true spirit and scope of the invention as defined in the claims.

What is claimed is:

1. A rotor especially adapted for dehulling sunflower seeds, comprising:

a disc adapted to be rotated;

means for feeding sunflower seeds to a central portion of said disc;

substantially straight radially-disposed blades mounted on said disc extending from the edge of said disc to a position adjacent said central portion thereof for guiding the sunflower seeds from said central portion radially outward therefrom to the edge of said disc whereby the seeds are ejected radially outwardly of said disc along said blades by centrifugal force, said blades comprising a plate inclined with respect to said disc in the direction of disc rotation and forming with said disc a radial channel having a height conforming to the thickness of sunflower seeds adapted to orient the seeds with their major axes parallel to the radial channel axis as the seeds are ejected outwardly along said blades;

an annular impact ring surrounding said disc; and means for sweeping seeds out of the path of said blades to clear the path of seed portions which rebound off said impact ring and avoiding interference by said rebounding seed portions with the seeds being ejected outwardly and maintaining said outwardly ejected seed in their proper orientation with their major axes parallel to the radial channel axis as the seeds are ejected outwardly of said disc toward said impact band, said sweeping means comprising fins mounted on said disc in front of said blades in the direction of disc rotation and extending radially outward of said disc beyond the most radially outward portion of said blades to a position spaced slightly inwardly from the face of said impact ring and each of said fins being constructed and arranged to intercept rebounding seed portions conveyed to the impact ring by the blade preceeding in the direction of disc rotation and to divert said rebounding seed portions away from the path of the sunflower seeds conveyed to the impact ring by the blade following in the direction of disc rotation.

2. The machine of claim 1 in which a plurality of inclined flat fingers are circumferentially-disposed beneath said impact ring to provide supplemental impact surfaces for dehulling said seeds.

3. The machine of claim 2 in which said flat fingers have two inclinations, one with reference to the rotor radius and one with reference to the rotor axis.

4. The machine of claim 1 in which said radial channel has a cross section wider than it is high so that generally-flat seeds are ejected as a spinning disc with their fault lines striking said impact ring.

5. The machine of claim 4 which also includes a plurality of generally radially-disposed flat fingers mounted beneath said impact rings to provide supplemental impact surfaces.

* * * * *